United States Patent [19]

Hague et al.

[11] 4,075,747

[45] Feb. 28, 1978

[54] MANUFACTURE OF METAL STRIP

[75] Inventors: David P. Hague; Dalip T. Malkani; Andrew Middlemiss; Stuart Scholey, all of Sheffield, England

[73] Assignee: British Steel Corporation, London, England

[21] Appl. No.: 745,559

[22] Filed: Nov. 29, 1976

[30] Foreign Application Priority Data

Nov. 28, 1975 United Kingdom ..... 49056/75

[51] Int. Cl.[2] ..... B21D 33/00

[52] U.S. Cl. ..... 29/18; 29/17 R; 242/78.3; 72/148

[58] Field of Search ..... 29/17 R, 18, 118; 72/148, 289, 71; 242/74, 74.1, 74.2, 78.1, 78.3; 82/46 R, 100, 101

[56] References Cited

U.S. PATENT DOCUMENTS

| | | | |
|---|---|---|---|
| 922,814 | 5/1909 | Reece | 72/289 |
| 3,460,366 | 8/1969 | Musial et al. | 29/17 |
| 3,748,935 | 7/1973 | Beauchet | 82/101 |

*Primary Examiner*—Lowell A. Larson
*Attorney, Agent, or Firm*—Bacon & Thomas

[57] ABSTRACT

Metal strip is produced by feeding a cutting tool continuously into the peripheral surface of a rotating cylindrical metal workpiece and coiling the peeled strip continuously around a coiler drum. The strip is initially coiled by means of a clamp connected by a flexible linkage to the coiler drum which grips the leading edge of the strip to pull it around the periphery of the drum.

9 Claims, 5 Drawing Figures

MANUFACTURE OF METAL STRIP

This invention relates to the manufacture and processing of metal strip. In one aspect it is concerned with the manufacture of metal strip by peeling a layer of metal from the surface of a rotating workpiece. In another aspect it is concerned with the coiling of metal strip.

Proposals have previously been made for the production of metal strip which involve peeling a surface layer from a rotating billet and collecting the peeled strip around a windup mandrel. In order to start the process working, it was proposed that the leading portion of the peeled strip should be fed towards the mandrel and wrapped around the mandrel by means of guides and a belt wrapper assembly which holds the peeled strip around the mandrel. This proposal suffers from certain disadvantages. Firstly, the leading portion of the peeled strip has to be fed relatively slowly onto the mandrel to avoid the risk of the strip buckling. Secondly, the nature of the wrapping technique means that it takes a short time before the tension applied to the peeled strip reaches a value consistent with the production of peeled strip having a uniform thickness. Thus the starting up of the process is somewhat slow, and the initial portion of the peeled strip may be of unsuitable thickness for consistent further processing. Furthermore belt wrapper assemblies are relatively complicated pieces of equipment which require considerable maintenance.

According to one aspect of the invention a method of manufacturing metal strip includes the steps of rotating a cylindrical metal workpiece about its longitudinal axis, feeding a cutting tool continuously into the peripheral surface of the workpiece as it rotates so as to produce a continuous metal strip peeled from the surface of the workpiece, and collecting the peeled strip by winding it around a coiler, said method including the steps of gripping the leading portion of the strip peeled from the workpiece by clamp means connected by a flexible linkage to the coiler, and thereby pulling the peeled strip around the coiler.

According to another aspect of the invention, apparatus for manufacturing metal strip from a cylindrical metal workpiece includes means for rotating the workpiece about its longitudinal axis, a cutting tool together with means for feeding said cutting tool continuously into the peripheral surface of the workpiece so as to produce a continuous metal strip peeled from the surface of the workpiece, coiler means for collecting the peeled strip, and clamp means connected by a flexible linkage to the coiler means said clamp means being adapted to grip the leading portion of the strip peeled from the workpiece and pull the strip around the coiler means.

The peeled strip leaving the workpiece is preferably held at a substantially constant angle to the tangent of the workpiece at the position where the cutting tool engages the workpiece.

The flexible linkage may include a metal strip which in use is wrapped around the coiler means. The clamp means preferably has jaws which are resiliently biased towards one another, and are initially mounted on the apparatus such that actuation of the coiler means causes the clamp jaws to close on the grip the leading portion of the strip.

The workpiece may be disc shaped with its longitudinal axis equal in length to the width of the peeled strip.

Alternatively the workpiece may be in a billet form, the length of the billet's longitudinal axis being greater than the width of the peeled strip. In this case strip may be peeled in turn from sections of the billet, by using a parting tool in combination with the cutting or peeling tool. The function of the parting tool is then to cut a groove into the peripheral surface of the billet ahead of the cutting or peeling tool such that the peeled strip has two free edges as it is cut or peeled from the billet. This arrangement is described in greater detail in our copending United Kingdom Patent Application No. 49057/75. In both cases the workpiece may be of annular configuration.

According to a further aspect of the invention a method of processing metal strip includes coiling the metal strip as it leaves a treatment stage, said method including gripping the leading portion of the strip exiting from the treatment stage by clamp means connected by a flexible linkage to a coiler, and thereby pulling the strip around the coiler.

According to a still further aspect of the invention apparatus for coiling metal strip leaving a treatment stage includes coiler means for collecting the metal strip, and clamp means connected by a flexible linkage to the coiler means, said clamp means being adapted to grip the leading portion of the strip exiting from the treatment stage and pull the strip around the coiler means.

The treatment stage may include a rolling mill in which the mtal strip is reduced in thickness.

An embodiment of the invention will now be described by way of example only with reference to the accompanying drawings in which.

Figure 1:
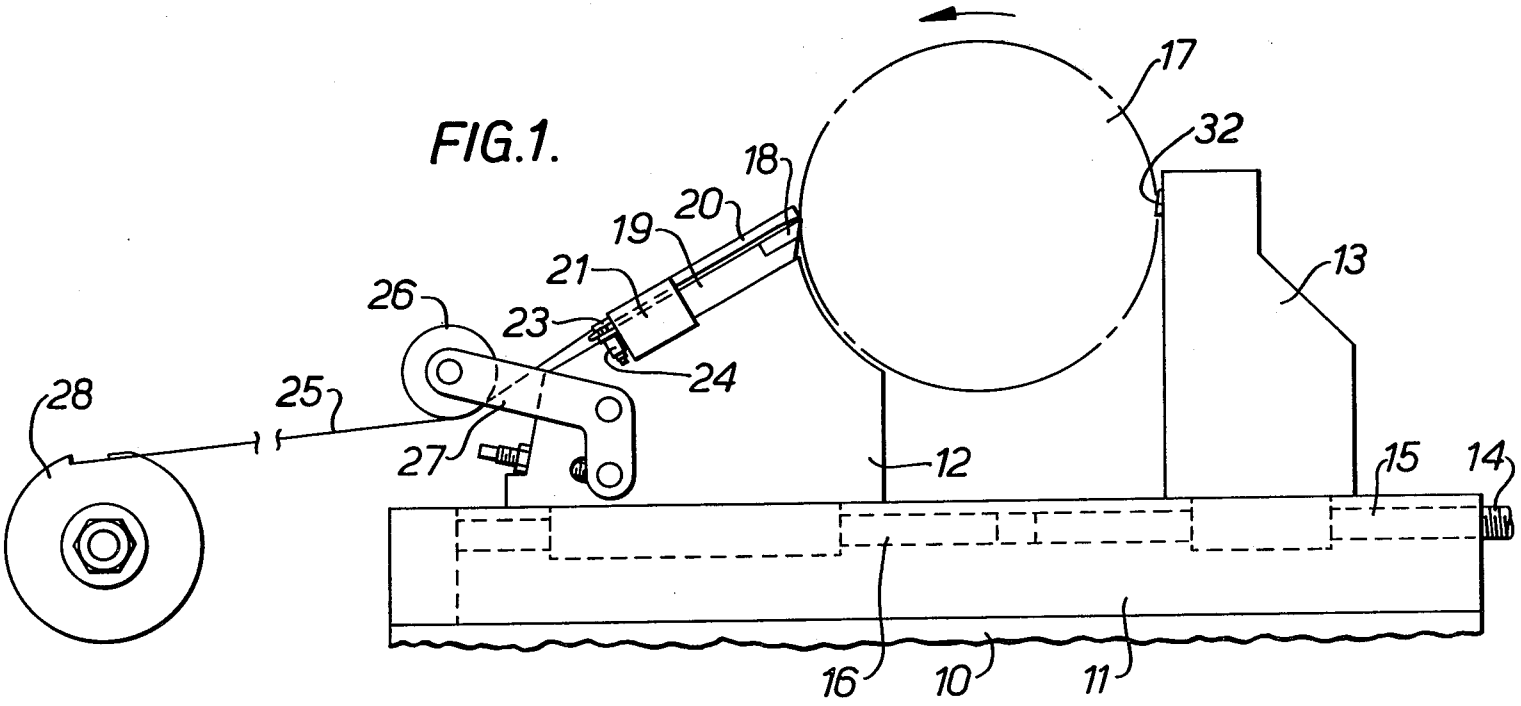
FIG. 1 is an end elevation of an apparatus for manufacturing metal strip.

Referring to FIG. 1, a bedway 10 supports a horizontal slideway 11. A peeling tool holder 12 and a parting tool holder 13 are slidably moveable on the slideway 11 and can be driven towards one another by a common lead screw 14 which is in turn connected to a hydraulic drive motor (not shown). The lead screw 14 has a first section 15 associated with the parting tool holder 13 which is threaded in an opposite sense to a second section 16 of the lead screw 14 associated with the peeling tool holder 12. A circular cross-section steel billet 17 is mounted for rotation about its longitudinal axis between the peeling tool holder 12 and the parting tool holder 13. The billet 17 is rotatably driven by the same hydraulic motor (not shown) as that which drives the lead screen 14, although the gearing is different.

Figure 2:
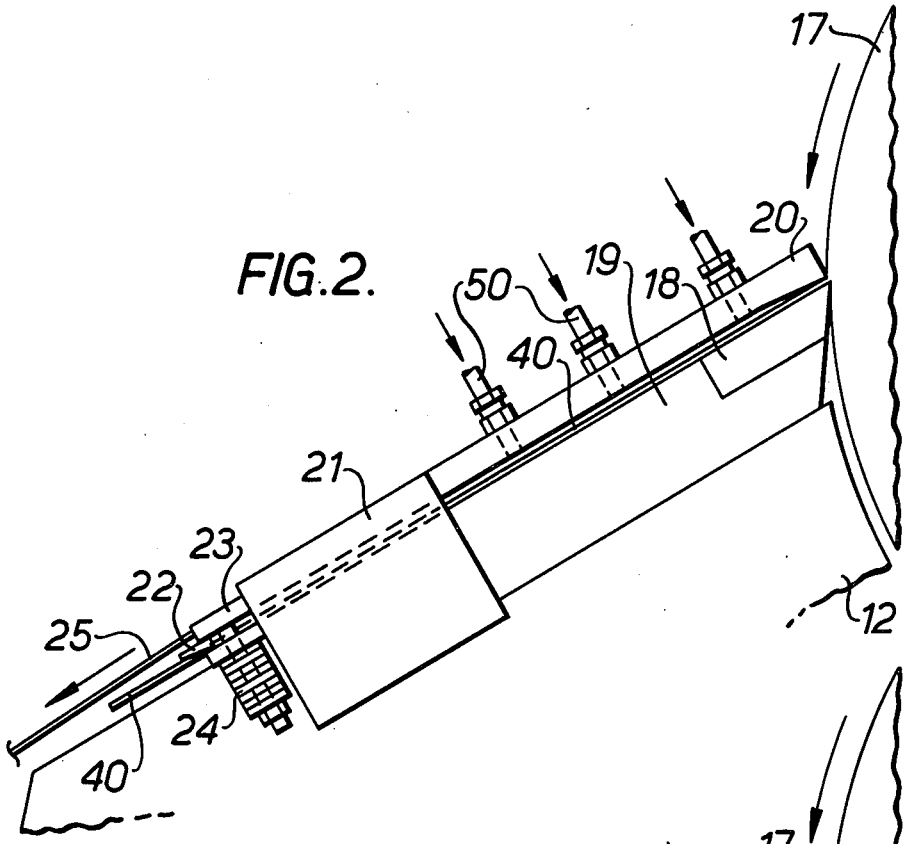
FIGS. 2 and 3 show a detail of the apparatus of FIG. 1 and illustrate two stages in the operation of the apparatus.
Figure 3:
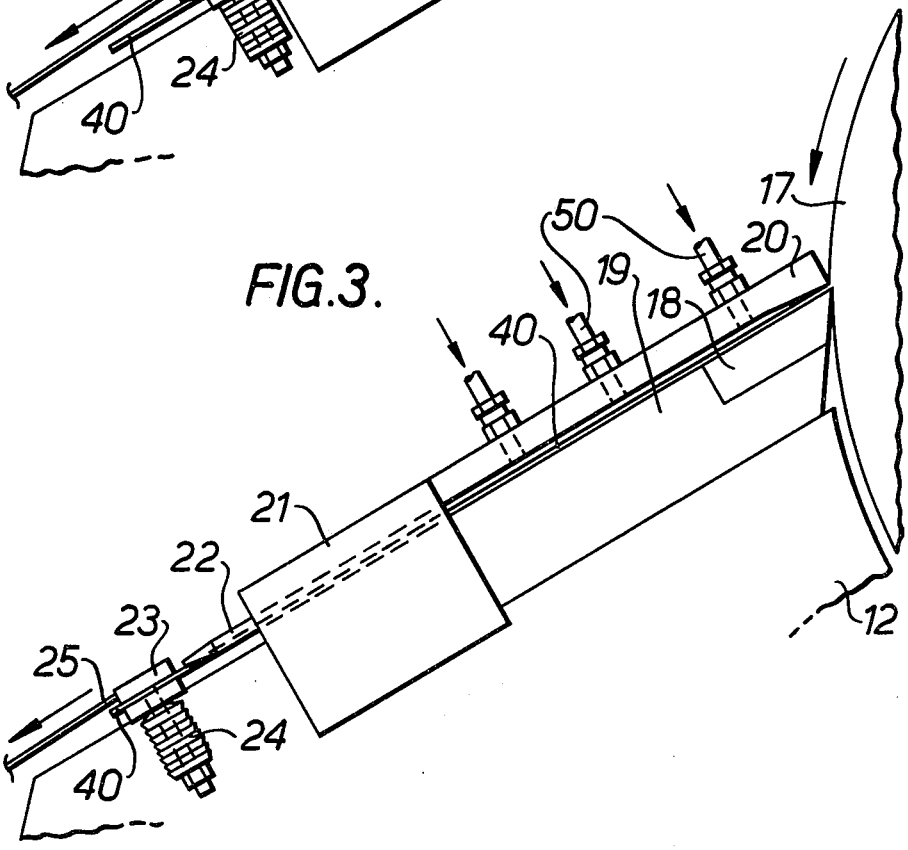

The upper part of the peeling tool holder 12 is seen more clearly in FIGS. 2 and 3. A peeling tool 18 mounted in a tool block 19 is rigidly secured to the peeling tool holder 12 such that the cutting edge of the peeling tool 18 engages the surface of the billet 17. A strip guide plate 20 is held by a guide plate support 21 mounted on the peeling tool holder 12 so that it is spaced a small distance away from and parallel to the upper surface of the tool block 19. The guide plate 20 extends so that it is almost in contact with the surface of the rotatable billet 17. A parting tool 32 is fitted on the parting tool holder 13 and makes a small groove in billet 17 as it rotates at a position about 10cm from the end of the billet 17.

Figure 4:
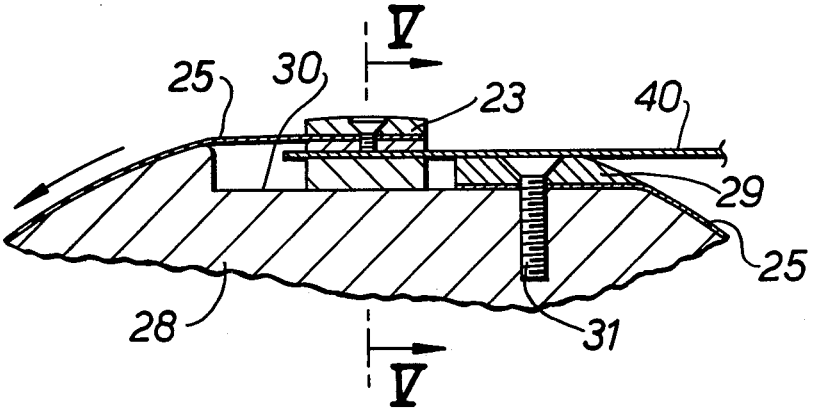
FIG. 4 is a sectional elevation of a further detail of the apparatus of FIG. 1.

Two locating pins 22 extend from the guide plate support 21 on the side of the support 21 distant from the tool block 19. The pins 22 are spaced apart from one another by a distance slightly greater than the width of the peeling tool 18. Prior to the commencement of strip peeling a clamp 23 is fitted on the locating pins 22 such that the jaws of the clamp 23, which are resiliently biased towards one another by two sets of disc springs 24, are held apart by the pins 22. A guide strip 25 made of shim steel is attached to the clamp 23 and extends away from the guide plate support 21 around the lower portion of an idler roller 26 mounted on an adjustable arm 27 which is fitted on the peeling tool holder 12. The guide strip 25 at its end distant from the clamp 23 is attached to the periphery of a coiling drum 28 between a plate 29 (see FIG. 4) and a recessed portion 30 of the periphery of the drum 28. Bolts 31 which pass through holes in the guide 25 secure the plate 29 and the guide strip 25 to the recessed portion 30 of the periphery of the drum 28. The drum 28 is drivable in the direction shown by the arrow in FIG. 4 by drive means (not shown) which is independent of the hydraulic drive for the rotatable billet 17. A mechanical or magnetic clutch system (not shown) is interposed between the drive means and the drum 28 to facilitate rapid acceleration of the drum to its required operating speed.

Figure 5:
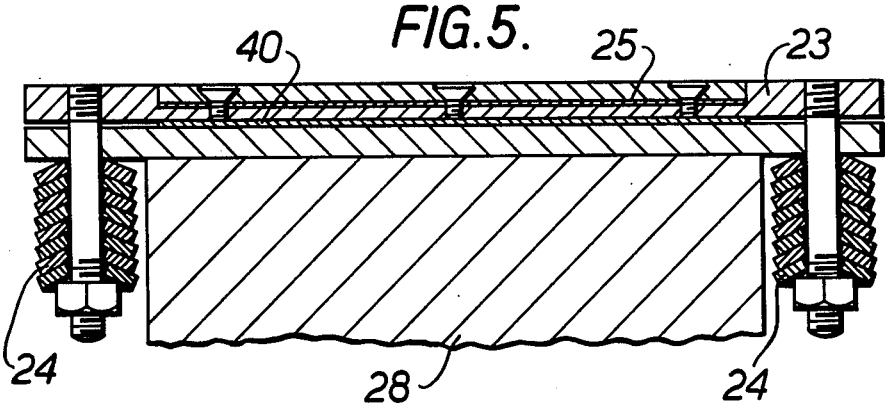
FIG. 5 is a view on line V—V of FIG. 4.

Upon starting-up the equipment, the drive means to the coiling drum 28 is actuated with the clutch system disengaged. At the same time, drive to the billet is initiated, the peripheral speed of the billet gradually increasing, whilst, the parting tool 32 and the peeling tool 18 are simultaneously driven into the peripheral surface of the billet 17. Since the parting tool 32 cuts a narrow groove about 180° before the peeling tool 18, and 10cm along the length of the billet 17, the peeling tool which is 10cm wide is able to cut cleanly a just less than 10cm width of steel strip 40 with free edges from the billet 17. The leading portion of the peeled strip 40 passes down the gallery formed between the lower surface of guide plate 20 and the upper surface of the tool block 19 reaching the position shown in FIG. 2. The clutch system of the coiling drum drive is then engaged, either manually or in response to a sensor (not shown) which determines the presence of the strip 40 at the clamp 23, and the peripheral speed of the coiler set at a value which is controlled at a constant proportion (between 0.85 and 0.28) of the peripheral speed of the rotatable billet. The guide strip 25 is thereby pulled around the coiling drum 28. The guide strip 25 in turn pulls the clamp 23 off the locating pins 22, the disc springs 24 causing the jaws of clamp 23 to grip the leading section of peeled strip 40. The peeled strip 40 is thus pulled around the coiling drum 28 at a constant level of tension determined by the ratio between the peripheral speed of the rotatable billet and the strip speed which ensures that constant thickness is maintained even during periods of acceleration. It can be seen from FIGS. 4 and 5 that the clamp 23 after one complete rotation of the coiling drum 28 is pulled into the recessed portion 30 of the periphery of the coiling drum 28 and the disc springs 24 are then positioned on either side of the width of the coiling drum 28 (see FIG. 5). The upper surface of the clamp 23 is shaped so that the next lap of peeled strip 40 forms a circular lap around the coiling drum 28. The idler roller 26 ensures that the peeled strip 40 is pulled away from the billet 17 at a constant angle, irrespective of the changing diameter of the coil of peeled strip accumulating on the coiling drum 28.

The apparatus is now run until the section of billet 17 which is being peeled is reduced to a small diameter, the peeled strip 40 being gathered on the coiling drum 28. The apparatus is then stopped and the full coiler drum 28 removed and replaced with an empty drum complete with guide strip 25 and clamp 23. At the same time the peeling tool holder 12 and the parting tool holder 13 are returned to their original position and the billet 17 is advanced so that the next section of billet 17 is presented to the peeling tool 18. The operation of the apparatus is then repeated in the manner described previously. The peeled strip 40 which has accumulated on the coiler drum 28 is decoiled onto a separate mandrel (not shown) so that the coiler drum and clamp can be re-used in the apparatus.

In order to cool the steel strip 40 peeled from the billet 17, a number of cooling fluid inlets 50 are provided which pass through the guide plate 20 and direct fluid onto the peeled strip 40. Alternatively, compressed air or other suitable fluid may be passed through inlets in the guide plate 20 and/or the tool block 19 into the gallery through which the strip 40 passes. The air or other fluid provides a fluid bearing which reduces the possibility of the leading portion of the strip jamming within the gallery. Alternatively, or additionally the surfaces of the gallery can be coated with an anti-friction material.

We claim:

1. Apparatus for manufacturing metal strip from a cylindrical metal workpiece including means for rotating the workpiece about its longitudinal axis, a cutting tool together with means for feeding said cutting tool continuously into the peripheral surface of the workpiece so as to produce a continuous metal strip peeled from the surface of the workpiece, coiler means for collecting the peeled strip, clamp means positioned to receive the leading portion of the strip peeled from the workpiece and connected to the coiler means, means for guiding and leading portion of peeled strip towards and into the mouth of the clamp means, and means responsive to the leading portion of the strip entering the mouth of the clamp means to actuate the clamp means to grip the leading portion of the peeled strip and to cause the coiler means to pull the clamped strip around the coiler.

2. Apparatus as claimed in claim 1 wherein adjustable guide means is provided to hold the peeled strip leaving the workpiece at a constant angle to the tangent of the workpiece at the position where the cutting tool engages the workpiece.

3. Apparatus as claimed in claim 1 wherein the clamp means is connected to the coiler by a flexible linkage comprising a metal strip which in use is wrapped around the coiler means.

4. Apparatus as claimed in claim 1 wherein the clamp means has jaws which are resiliently biassed towards one another by spring means.

5. Apparatus as claimed in claim 4 wherein mounting means is provided for the clamp means which holds the jaws apart until actuation of the coiler means causes the jaws to grip the leading portion of the peeled strip.

6. Apparatus as claimed in claim 1 wherein a parting tool is provided, said parting tool being adapted to cut a groove into the peripheral surface of the workpiece ahead of the cutting tool such that the strip is cut from the workpiece with two free edges.

7. In a method of manufacturing metal strip which includes the steps of rotating a cylindrical metal workpiece about its longitudinal axis, feeding a cutting tool continuously into the peripheral surface of the workpiece as it rotates so as to produce a continuous metal strip peeled from the surface of the workpiece, and collecting the peeled strip by winding it around a coiler, the improvement which comprises guiding the leading portion of the strip peeled from the workpiece towards and into the mouth of clamp means connected to the coiler and to cause actuating the clamp to grip the strip leading portion and the coiler to pull the peeled strip around the coiler.

8. A method as claimed in claim 7 wherein the workpiece is disc shaped and its longitudinal axis is then equal in length to the width of the peeled strip.

9. A method as claimed in claim 7 wherein the workpiece is in billet form, the length of the billet's longitudinal axis being greater than the width of the peeled strip, and the strip is peeled in turn from sections of the billet by using a parting tool in combination with the cutting tool, the parting tool cutting a groove into the peripheral surface of the billet ahead of the cutting tool such that the peeled strip has two free edges as it is peeled from the billet.

* * * * *